US007654244B2

(12) United States Patent
Linderyd et al.

(10) Patent No.: US 7,654,244 B2
(45) Date of Patent: Feb. 2, 2010

(54) ARRANGEMENT AND METHOD FOR A COMBUSTION ENGINE

(75) Inventors: Johan Linderyd, Sundbyberg (SE); Anders Larsson, Södertälje (SE)

(73) Assignee: Scania CV AB (publ) (SE)

( * ) Notice: Subject to any disclaimer, the term of this patent is extended or adjusted under 35 U.S.C. 154(b) by 0 days.

(21) Appl. No.: 12/093,474

(22) PCT Filed: Dec. 8, 2006

(86) PCT No.: PCT/SE2006/050563

§ 371 (c)(1),
(2), (4) Date: Jun. 5, 2008

(87) PCT Pub. No.: WO2007/073329

PCT Pub. Date: Jun. 28, 2007

(65) Prior Publication Data

US 2008/0295799 A1 Dec. 4, 2008

(30) Foreign Application Priority Data

Dec. 21, 2005 (SE) ..... 0502848

(51) Int. Cl.
*F02B 17/00* (2006.01)

(52) U.S. Cl. ..... 123/295; 123/299; 123/305

(58) Field of Classification Search ..... 123/295, 123/299, 305

See application file for complete search history.

(56) References Cited

U.S. PATENT DOCUMENTS

| | | | | |
|---|---|---|---|---|
| 6,463,907 | B1 | 10/2002 | Hiltner | |
| 6,659,071 | B2 * | 12/2003 | LaPointe et al. | 123/299 |
| 6,679,224 | B2 * | 1/2004 | Stanglmaier | 123/431 |
| 6,959,693 | B2 * | 11/2005 | Oda | 123/431 |
| 7,212,908 | B2 * | 5/2007 | Li et al. | 701/108 |
| 2001/0022168 | A1 * | 9/2001 | Teraji et al. | 123/295 |
| 2001/0045201 | A1 * | 11/2001 | Yoshizawa et al. | 123/299 |
| 2003/0168037 | A1 * | 9/2003 | zur Loye et al. | 123/295 |
| 2003/0233996 | A1 * | 12/2003 | Marriott et al. | 123/295 |
| 2005/0092286 | A1 * | 5/2005 | Sasaki et al. | 123/295 |
| 2008/0178836 | A1 * | 7/2008 | Yamashita et al. | 123/295 |

FOREIGN PATENT DOCUMENTS

| | | | |
|---|---|---|---|
| EP | 1 234 966 | A2 | 8/2002 |
| WO | WO 2004/051060 | A1 | 6/2004 |
| WO | WO 2005/019627 | A1 | 3/2005 |

OTHER PUBLICATIONS

International Search Report dated Mar. 1, 2007 issued in corresponding PCT Application No. PCT/SE2006/050563.

* cited by examiner

*Primary Examiner*—Erick Solis
(74) *Attorney, Agent, or Firm*—Ostrolenk Faber LLP

(57) ABSTRACT

An arrangement and a method for a combustion engine for self-ignition of a fuel mixture. A first device supplies a first partial quantity of the fuel mixture to the combustion space, and a second device supplies a second partial quantity of the fuel mixture to the combustion space, which second partial quantity of the fuel mixture is at a different fuel concentration from the first partial quantity of the fuel mixture. The devices supply the first and the second partial quantities of the fuel mixture as to create in the combustion space at least one region which is at a higher fuel concentration than other regions and in which the self-ignition of the fuel mixture is intended to start.

13 Claims, 2 Drawing Sheets

ARRANGEMENT AND METHOD FOR A COMBUSTION ENGINE

CROSS REFERENCE TO RELATED APPLICATION

The present application is a 35 U.S.C. 371 national phase conversion of PCT/SE2006/050563, filed 8 Dec. 2006, which claims priority of Swedish Application No. 0502848-5, filed 21 Dec. 2005. The PCT International Application was published in the English language.

BACKGROUND TO THE INVENTION, AND STATE OF THE ART

The present invention relates to an arrangement and a method for causing self starting of ignition in a combustion engine by separation of fuel quantities in a combustion space.

The invention is related to the type of combustion engines usually called HCCI (Homogeneous Charge Compression Ignition) engine. An HCCI engine may be regarded as a combination of an Otto engine and a diesel engine. In an HCCI engine, a homogeneous mixture of fuel and air is compressed in a combustion space until self-ignition of the fuel mixture occurs. Advantages of HCCI engines are that they produce low discharges of nitrogen oxides NO, and soot particles while at the same time having a high degree of efficiency.

The combustion of the homogeneous fuel mixture usually takes place very rapidly, since all of the fuel mixture self-ignites at substantially exactly the same time. The relevant components are therefore subject to relatively large mechanical stresses while at the same time a loud noise occurs.

SUMMARY OF THE INVENTION

The object of the present invention is to provide an arrangement and a method which make possible a more prolonged combustion process in the type of combustion engine mentioned in the introduction so that the stresses on components and the noise which occurs during combustion are reduced.

This object is achieved with the arrangement of the kind mentioned in the introduction which is characterized by the features described below. According to the invention, two partial quantities of an entire fuel mixture are supplied to the combustion engine's combustion space, wherein one partial quantity is at a higher fuel concentration than the other partial quantity. The one partial quantity of fuel mixture may thus be at such a fuel concentration that it self-ignites when the combustion engine's crankshaft is at an optimum position. The other partial quantity of the fuel mixture may be at a leaner fuel concentration. During the short period of time from when the partial quantities of the fuel mixture are led into the combustion space until the fuel mixture self-ignites, the two partial quantities substantially fail to mix so thoroughly that a totally homogeneous fuel mixture occurs in the combustion space. There will therefore substantially always be a more or less large region which only contains the partial quantity with the higher fuel concentration. When the pressure in the combustion space becomes great enough, the fuel mixture will self-ignite in that region, causing a powerful development of heat and a pressure rise leading to self-ignition of leaner fuel mixtures in surrounding regions. The result is a rapid combustion process locally in the combustion space while the overall combustion process takes a significantly longer time. Such a relatively prolonged combustion process in the combustion space results in significantly smaller stresses on relevant components of the engine, which may therefore have a longer service life. It also reduces the amount of noise generated by an during the combustion, as compared with when a totally homogeneous fuel mixture is burnt.

According to a preferred embodiment of the present invention, a first fuel delivery arrangement comprises a first inlet line with a first aperture to the combustion space for supplying the first partial quantity of the fuel mixture, and a second fuel delivery arrangement comprises a second inlet line with a second aperture to the combustion space for supplying the second partial quantity of the fuel mixture. The apertures are situated at different points in the combustion space. Such positioning of the apertures for supply of the partial quantities of the fuel mixture counteracts at least an immediate mixing of the partial quantities in the combustion space, thereby promoting the creation of at least one region with a higher fuel concentration where self-ignition can start. With advantage, the first and second inlet lines are so designed that the first partial quantity of the fuel mixture and the second partial quantity of the fuel mixture enter the combustion space in such directions that mixing of the respective partial quantities is counteracted to such an extent that at least the region with the higher fuel concentration is created. Providing the different partial quantities with suitable directions of flow into the combustion space makes it possible for mixing of the partial quantities to be further counteracted with the object of creating a region with the higher fuel concentration. The direction of inflow of the partial quantities is preferably such that the region with the higher fuel concentration is created in a predetermined portion of the combustion space. With advantage, that region is created in a central portion of the combustion space.

According to another preferred embodiment of the present invention, the arrangement comprises a control unit operable to control the first and the second fuel delivery arrangement so as to make possible individual supply of the partial quantities of the fuel mixture at different times. The control unit is with advantage an electrical control unit comprising software which makes such control possible. The occurrence of a homogenous mixture of the partial quantities can be further counteracted by not supplying the different partial quantities at exactly the same time. It is thus relatively easy to create a region with the higher fuel concentration where the self-ignition is intended to start. Preferably, the first fuel delivery arrangement comprises a first inlet valve which has an open state allowing the first partial quantity of the fuel mixture to flow into the combustion space, and said second means comprises a second inlet valve which in an open state allows the second partial quantity of the fuel mixture to flow into the combustion space. The control unit is operable to control the first inlet valve and the second inlet valve in such a way as to make possible individual supply of the partial quantities of the fuel mixture at different times. Using two inlet valves in this way makes it relatively easy to control and adjust the supply of two partial quantities with different fuel concentrations to a combustion space.

According to another preferred embodiment of the present invention, the control unit is operable to control the compositions of the first partial quantity of the fuel mixture and the second partial quantity of the fuel mixture. For the fuel mixture to have desired characteristics, it is important that both the first partial quantity of the fuel mixture and the second partial quantity of the fuel mixture be of substantially optimum compositions. The first fuel delivery arrangement may comprise a first fuel supply element for supply of fuel of the first partial quantity of the fuel mixture, and the second fuel delivery arrangement may comprise a second fuel supply element for supply of fuel of the second partial quantity of the fuel mixture. The control unit is operable to control the first fuel supply element so that the first partial quantity of the fuel mixture comprises a first desired amount of fuel, and the second fuel supply element so that the second partial quantity of the fuel mixture comprises a second desired amount of fuel. One partial quantity may thus be at a higher fuel concentration than the other partial quantity. The first fuel supply element and/or the second fuel supply element may comprise a fuel pump and an injection nozzle. The fuel can thus be injected into and mixed with air which is supplied to the combustion space when the inlet valves are open. Different amounts of fuel can be injected at different times in order to further promote the occurrence of regions with different fuel concentrations.

According to another preferred embodiment of the present invention, the first fuel delivery arrangement and the second fuel delivery arrangement comprise an exhaust gas source. The control unit being operable to control the first fuel delivery arrangement and the first fuel delivery arrangement and the second fuel delivery arrangement in such a way that exhaust gases are supplied from the exhaust gas source so that the first partial quantity of the fuel mixture and the second partial quantity of the fuel mixture will each contain a desired amount of exhaust gases. Adding exhaust gases to the partial quantities of the fuel mixture is a powerful way of controlling the self-ignition of the fuel mixture. It may also reduce the formation of nitrogen oxides NOx during the subsequent combustion process. Said exhaust gas source may comprise a first return line comprising a first EGR valve, and a second return line comprising a second EGR valve. The control unit is adapted to control the first EGR valve and the second EGR valve so that the first partial quantity of the fuel mixture and the second partial quantity of the fuel mixture will each contain a desired amount of exhaust gases. Using such a return line with an EGR valve makes it possible for a desired amount of exhaust gases to be mixed first with the air and thereafter with the fuel.

The object of the intention is also achieved with the method of the kind disclosed herein.

BRIEF DESCRIPTION OF THE DRAWINGS

A preferred embodiment of the invention is described below by way of example with respect to the attached drawings, in which.

DETAILED DESCRIPTION OF A PREFERRED EMBODIMENT OF THE INVENTION

Figure 1:
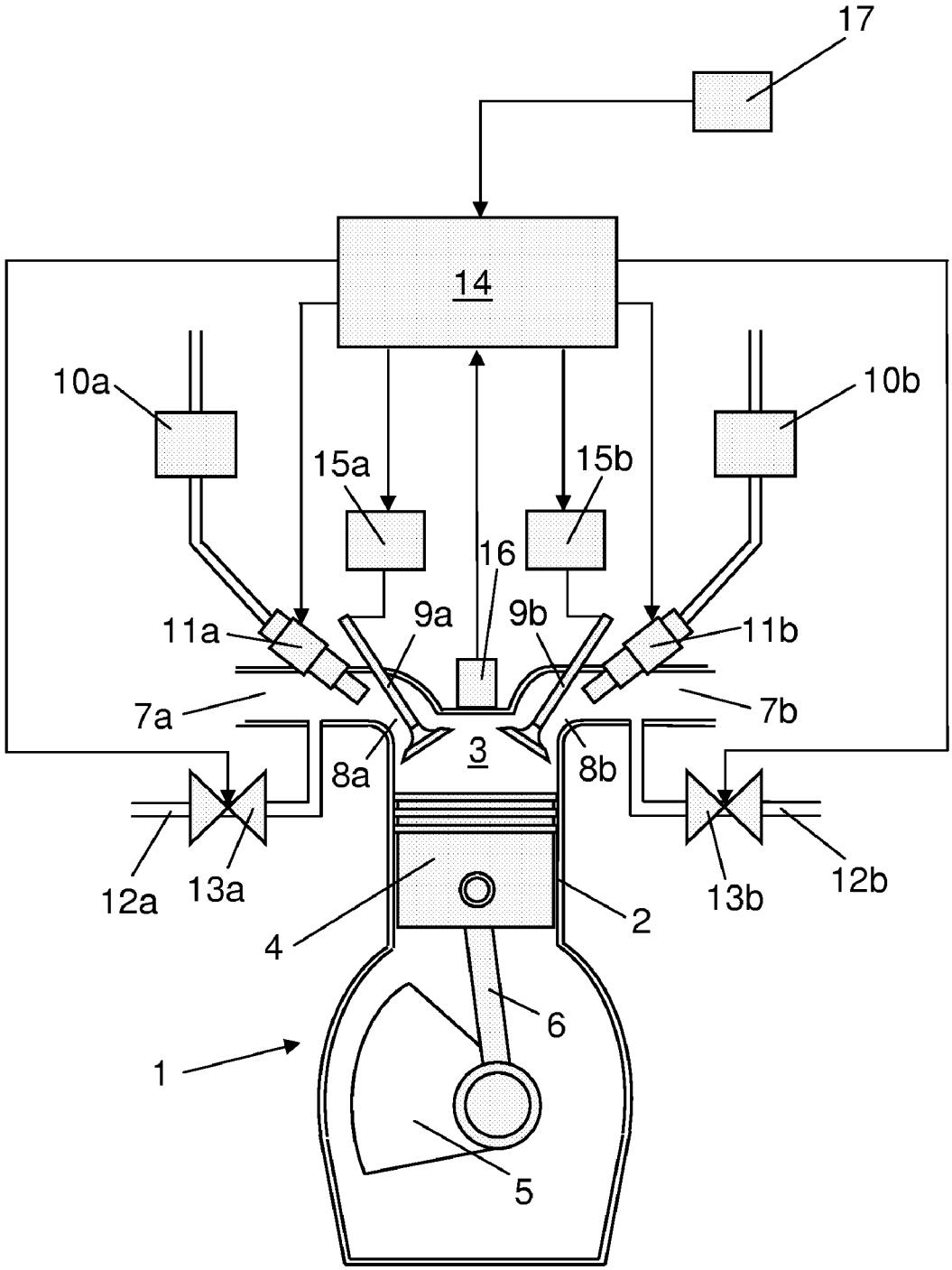
FIG. 1 depicts a combustion engine with an arrangement according to the present invention and FIG. 2 depicts the combustion engine in FIG. 1 viewed from another angle.
Figure 2:
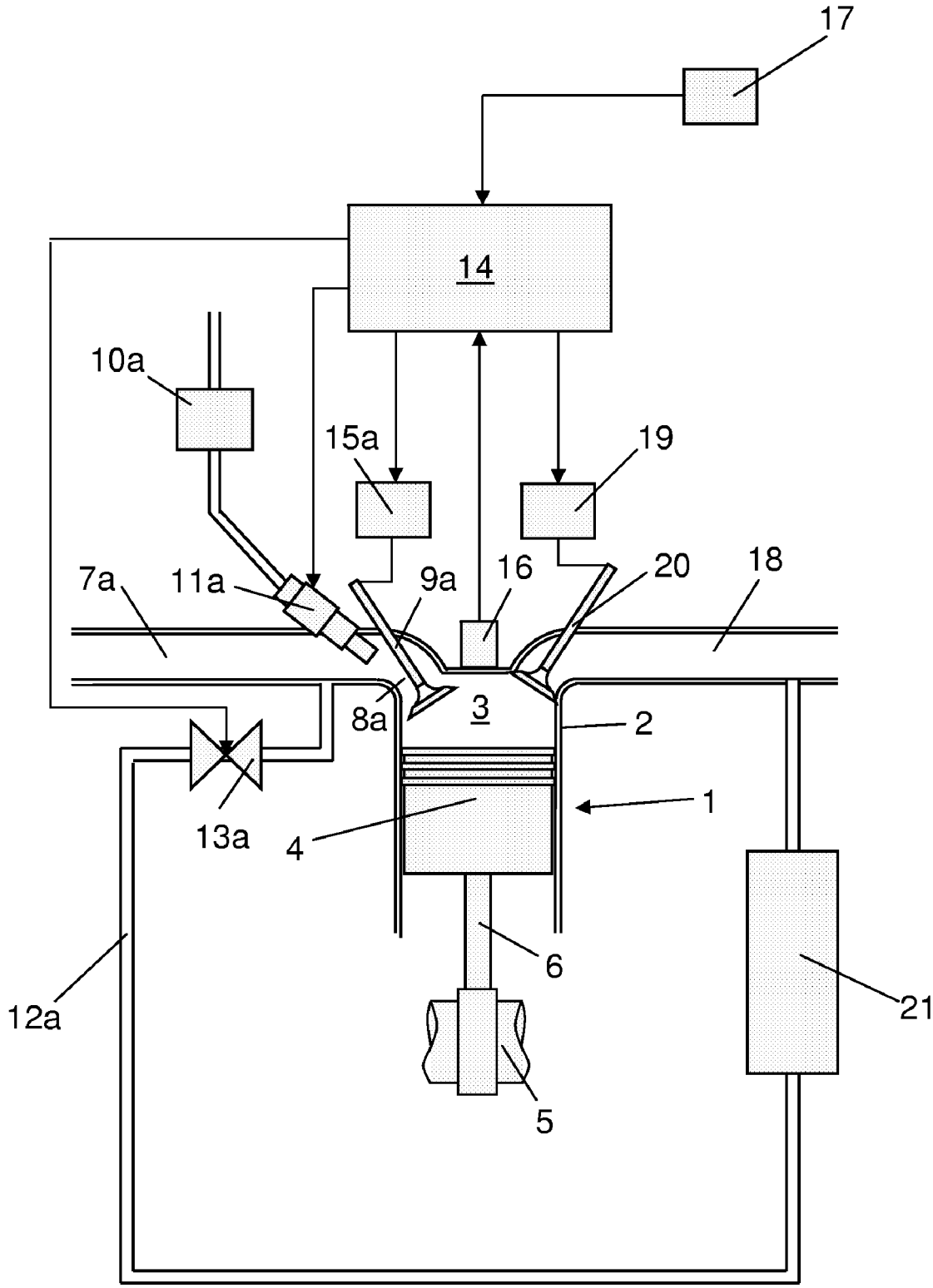

FIGS. 1 and 2 depict a combustion engine 1 of the type in which a homogeneous mixture of fuel and air is compressed until self-ignition of the mixture is caused by the heat developed during the compression. Such an engine is usually called an HCCI (Homogeneous Charge Compression Ignition) engine. FIGS. 1 and 2 show one cylinder 2 of the combustion engine 1. The cylinder 2 comprises a combustion space 3 which is bounded downwards by a piston 4 which is arranged for movement. The piston 4 is connected to a crankshaft 5 via a connecting rod 6. The motion of the piston 4 in the cylinder 2 is converted to a rotary motion by the crankshaft 5. The combustion engine 1 may comprise any desired number of such cylinders 2.

FIG. 1 depicts a first inlet line 7*a* which has a first aperture 8*a* for leading air to the combustion space 3, and a second inlet line 7*b* which has a second aperture 8*b* for leading air to the combustion space 3. A first inlet valve 9*a* is arranged in the first aperture 8*a*, and a second inlet valve 9*b* is arranged in the second aperture 8*b*. First fuel supply elements in the form of a fuel pump 10*a* and an injection nozzle 11*a* are arranged close to the first inlet line 7*a*. Second fuel supply elements in the form of a fuel pump 10*b* and an injection nozzle 11*b* are arranged close to the second inlet line 7*b*. The first inlet line 7*a* is connected to a first return line 12*a* for exhaust gases. The first return line 12*a* comprises a first EGR valve 13*a* by which it is possible to return a desired amount of exhaust gases to the first inlet line 7*a*. The second inlet line 7*b* is correspondingly connected to a second return line 12*b* for exhaust gases. The second return line 12*b* comprises a second EGR valve 13*b* by which it is possible to return a desired amount of exhaust gases to the second inlet line 7*b*.

A control unit 14 is operable to control the injection nozzles 11*a, b* individually so that each of them supplies a desired amount of fuel at specified times. The control unit 14 is also operable to control the respective EGR valves 13*a, b* individually so that each of them adds a desired amount of exhaust gases to the air in the respective inlet lines 7*a, b*. It is thus possible to control the composition of the first partial quantity and the second partial quantity in terms of air, fuel and exhaust gases. The control unit 14 also controls the supply of partial quantities of the fuel mixture by controlling the respective inlet valves 9*a, b* individually by means of schematically depicted hydraulic systems 15*a, b* adapted to lifting the inlet valves 9*a, b* independently of the rotational position of the crankshaft 5. The control unit 14 may be a computer unit provided with suitable software 14*a* for performing the functions of the control unit 14. The control unit 14 is operable to provide a fuel mixture in the combustion space 3 which self-ignites when the crankshaft 5 is at a desired rotational position, by using information from, inter alia, a pressure sensor 16 concerning the prevailing pressure in the combustion space 3, and a sensor 17 concerning the rotational position of the crankshaft 5. In such cases, the sensor 17 may, for example, detect the position of the engine's flywheel.

FIG. 2 depicts the combustion engine 1 viewed from another angle whereby the first inlet line 7*a* with connecting components 8*a*-13*a*, 15*a* are visible. The second inlet line 7*b* with connecting components 8*b*-13*b*, 15*b* is thus not visible. FIG. 2 shows the cylinder 2 provided with an exhaust line 18 intended to lead the exhaust gases away from the combustion process in the combustion space 3. The control unit 14 is operable to control the discharge of exhaust gases from the combustion space 3 by a schematically depicted hydraulic system 19 which is responsible for the lifting of an exhaust valve 20. The lifting of the exhaust valve 20 can therefore take place independently of the rotational position of the crankshaft 5. The first return line 12*a* for exhaust gases has an extent from the exhaust line 18 to the first inlet line 7*a*. The first return line 12*a* comprises not only the first EGR valve 13*a* but also an EGR cooler 21 intended to cool the exhaust gases before they mix with the air in the first inlet line 7*a*. The second return line 12*b* has with advantage a certain common extent with the first return line 12*a*. The second return line may therefore comprise the same EGR cooler 21.

A problem with conventional HCCI engines is that the combustion of the homogeneous fuel mixture takes place very rapidly, since the whole fuel mixture self-ignites at substantially exactly the same time. Relevant components are therefore subject to large mechanical stresses while at the same time a loud noise occurs. According to the present invention, two partial quantities of the fuel mixture at different fuel concentrations are supplied to the combustion space 3. Supplying two such partial quantities of the fuel mixture separately makes it possible to create in the combustion space 3 at least one more or less large region which will be at a higher fuel concentration than adjacent regions. The self-ignition and combustion of the fuel mixture will thus take place first in that region. Thereafter, self-ignition of the adjoining regions with leaner fuel mixtures will be caused by the heat and pressure generated by the initial combustion. The result is a relatively prolonged combustion process in the combustion space 3.

To facilitate the creation of a region of higher fuel concentration in the combustion space 3, the first partial quantity of the fuel mixture is supplied via a first aperture 8*a* situated at a distance from the second aperture 8*b*. Thus the respective partial quantities of the fuel mixture will at least not mix immediately with one another after entering the combustion space 3. To further facilitate the creation of a region of higher fuel concentration in the combustion space, the first inlet line 7*a* and the second inlet line 7*b* have different curvatures close to their apertures 8*a, b* leading to the combustion space 3. For example, the shape of an inlet 7*a, b* may be such that it supplies its fuel mixture substantially radially into the combustion space, while the shape of the other inlet line 7*a, b* may be such that it supplies its fuel mixture substantially along the walls of the combustion space 3. Thus mixing of said partial quantities of the fuel mixture is further counteracted and favourable conditions are created for achieving a region in the combustion space 3 which will be at a higher fuel concentration than surrounding regions. With suitably shaped inlet lines 7*a, b* it is possible to determine the portion of the combustion space in which said region of higher fuel concentration will be created and the self-ignition will therefore start. With advantage, this portion is situated relatively centrally in the combustion space 3. To further make possible the creation of a region of higher fuel concentration in the combustion space, the control unit 14 may control the supply of the first partial quantity of the fuel mixture and the second partial quantity of the fuel mixture so that they are supplied are different times. The control unit 14 will therefore open and close the first inlet valve 9*a* and the second inlet valve 9*b* in such a way that the first partial quantity of the fuel mixture and the second partial quantity of the fuel mixture are supplied during different periods of time which may nevertheless overlap one another to a greater or lesser extent.

During operation of the combustion engine 1, the control unit 14 controls the EGR valves 13*a, b* in such a way that a desired amount of exhaust gases is led into the inlet lines 7*a, b*. When the piston 4 move downwards in the cylinder 2, the control unit 14 opens the inlet valves 9*a, b* at times which may therefore differ somewhat from one another. When the inlet valves 9*a, b* are open, air and exhaust gases are sucked into the expanding combustion space 3 via the respective inlet lines 7*a, b*. At the same time, the control unit 14 controls the inlet nozzles 11*a, b* so that fuel in well judged amounts is injected into the combustion space 3 via the apertures 8*a, b* of the respective inlet lines 7*a, b*. Thus a first partial quantity of the fuel mixture comprising a specific composition of air, exhaust gases and fuel is supplied via the first inlet line 7*a*, and a second partial quantity of the fuel mixture comprising a specific composition of air, exhaust gases and fuel is supplied via the second inlet line 7*b*. As the piston 4 turns at the lower extreme position, the control unit 14 closes the inlet valves 9*a, b*, which closures may thus take place at different times. The first partial quantity of the fuel mixture and the second partial quantity of the fuel mixture inevitably undergo some mixing in the combustion space, but the measures described above will prevent the partial quantity supplied from becoming a totally homogeneous mixture. The combustion space will therefore comprise at least one region at a higher fuel concentration than other regions.

The subsequent movement upwards of the piston 4 causes compression of the fuel mixture in the combustion space 3. The fuel mixture is subjected to a temperature increase which is related to the degree of compression. Substantially as the piston 4 passes an upper extreme position in the cylinder 2, the fuel mixture in the region of highest fuel concentration will have reached the temperature at which self-ignition takes place. During the combustion in this region, a powerful development of heat and increase in pressure take place, with the result that adjacent regions of lower fuel concentration self-ignite. Since not all of the fuel mixture in the combustion space 3 self-ignites simultaneously, the result is a relatively prolonged combustion process in the combustion space 3. The composition of the region of higher fuel concentration is such that the self-ignition of the fuel mixture takes place at an optimum crankshaft angle. The pressure increase which occurs in conjunction with the self-ignition results in the piston 4 being pushed downwards. When the piston 4 has passed the lower extreme position, the control unit 14 opens the exhaust valve 20. The piston 4 during its upward movement pushes the exhaust gases formed during combustion process out via the open exhaust valve 20 to the exhaust line 18.

The invention is in no way limited to the embodiment referred to in the drawing but may be varied freely within the scopes of the claims. The combustion engine need not be an HCCI engine but may be any desired combustion engine where a fuel mixture self-ignites under compression. FIG. 2 depicts one exhaust valve 20 but the cylinder 2 may of course be provided with more than one exhaust valve 20.

The invention claimed is:

1. An arrangement for a combustion engine, wherein the combustion engine comprises a combustion space, a piston which is arranged for movement in the combustion space and is operable to compress a fuel mixture in the combustion space for causing self-ignition of the fuel mixture in the combustion space the arrangement comprises a first fuel delivery arrangement operable to supply a first partial quantity of the fuel mixture to the combustion space, a second fuel delivery arrangement operable to supply a second partial quantity of the fuel mixture to the combustion space, wherein the second partial quantity of the fuel mixture is at a different fuel concentration than the first partial quantity of the fuel mixture, the fuel delivery arrangement operable to supply the partial quantities of the fuel mixture in such a way as to create at least one region in the combustion space which is at a higher fuel concentration than other regions in the combustion space and in which self-ignition of the fuel mixture is intended to start.

2. An arrangement according to claim 1, wherein the first fuel delivery arrangement comprises a first inlet line with a first aperture to the combustion space for supplying the first partial quantity of the fuel mixture, and the second fuel delivery arrangement comprises a second inlet line with a second aperture to the combustion space for supplying the second partial quantity of the fuel mixture, and the first and second apertures are situated at different points in the combustion space.

3. An arrangement according to claim 2, wherein each of the first inlet line and the second inlet line is shaped such that the first partial quantity of the fuel mixture and the second partial quantity of the fuel mixture are supplied to the combustion space in different directions, to counteract mixing of the respective partial quantities to such an extent that at least the region of higher fuel concentration is created in the combustion space.

4. A arrangement according to claim 1, further comprising a control unit operable to control the first fuel delivery arrangement and the second fuel delivery arrangement for causing individual supply of the first and second partial quantities of the fuel mixture at different times.

5. An arrangement according to claim 4, wherein the first fuel delivery arrangement comprises a first inlet valve having an open state that allows the first partial quantity of the fuel mixture to flow into the combustion space, and the second fuel delivery arrangement comprises a second inlet valve having an open state that allows the second partial quantity of the fuel mixture to flow into the combustion space, the control unit being operable to control the first inlet valve and the second inlet valve for enabling individual supply of the first and second partial quantities of the fuel mixture at different times.

6. An arrangement according to claim 4, wherein the control unit is operable to control the composition of the first partial quantity of the fuel mixture and the second partial quantity of the fuel mixture.

7. An arrangement according to claim 6, wherein the first fuel delivery arrangement comprises first fuel supply elements for supply of fuel to the first partial quantity of the fuel mixture, and the second fuel delivery arrangement comprises second fuel supply elements for supply of fuel to the second partial quantity of the fuel mixture, the control unit being operable to control the first fuel supply element so that the first partial quantity of the fuel mixture comprises a first desired amount of fuel, and to control the second fuel supply element so that the second partial quantity of the fuel mixture comprises a second desired amount of fuel.

8. An arrangement according to claim 7, wherein at least one of the first fuel supply element and the second fuel supply element comprises a fuel pump and an injection nozzle.

9. A arrangement according to claim 4, wherein at least one of the first fuel delivery arrangement and the second fuel delivery arrangement comprises an exhaust gas source, and the control unit is operable to control the first and the second fuel delivery arrangements so that exhaust gases are supplied from the exhaust gas source in such a way that the first partial quantity of the fuel mixture and the second partial quantity of the fuel mixture will each comprise a desired amount of exhaust gases.

10. An arrangement according to claim 9, wherein the exhaust gas source comprises a first return line comprising a first EGR valve, and a second return line comprising a second EGR valve, the control unit being operable to control the first EGR valve and the second EGR valve (13*b*) in such a way that the first partial quantity of the fuel mixture and the second partial quantity of the fuel mixture will comprise a desired amount of exhaust gases.

11. A method for controlling a combustion engine, wherein the combustion engine comprises a combustion space and a piston arranged for movement and operable to compress a fuel mixture in the combustion space for causing ignition of the fuel mixture in the combustion space, the method comprising supplying a first partial quantity of the fuel mixture to the combustion space, supplying a second partial quantity of the fuel mixture to the combustion space, wherein the second partial quantity of the fuel mixture is at a different fuel concentration than the first partial quantity of the fuel mixture, and the supplying of the partial quantities of the fuel mixture are such as to create at least one region in the combustion space which is at a higher fuel concentration than other regions in the combustion space and in which self-ignition of the fuel mixture is intended to start.

12. A method according to claim 11, wherein the first and the second quantities of the fuel mixture are supplied at different times, such that one of the fuel quantities is supplied in a first region in the combustion space and the other of the fuel quantities is not initially at or mixed into the first region in the combustion space.

13. A method according to claim 11, wherein the first and second fuel quantities are led into the combustion space from different directions to avoid the fuel quantities not being initially mixed in the same region in the combustion space.

* * * * *